US005322525A

United States Patent [19]

Rembold et al.

[11] Patent Number: 5,322,525

[45] Date of Patent: Jun. 21, 1994

[54] PROCESS FOR TREATING POLYAMIDE CONTAINING ARTICLES TO ENHANCE THEIR MOULDING STABILITY

[75] Inventors: Manfred Rembold, Aesch, Switzerland; Claude Eckhardt, Riedisheim, France; Peter Nesvadba, Marly, Switzerland

[73] Assignee: Ciba-Geigy Corporation, Ardsley, N.Y.

[21] Appl. No.: 969,617

[22] Filed: Oct. 30, 1992

[30] Foreign Application Priority Data

Nov. 1, 1991 [CH] Switzerland ..... 3194/91

[51] Int. Cl.[5] ..... D06M 13/228; C09B 67/00

[52] U.S. Cl. ..... 8/578; 8/551; 8/552; 8/567; 8/648; 8/920; 8/924; 8/925; 549/305; 549/307

[58] Field of Search ..... 8/578, 924, 925, 920, 8/551, 552, 567, 648

[56] References Cited

U.S. PATENT DOCUMENTS

| | | | |
|---|---|---|---|
| 2,535,098 | 12/1950 | Shorey et al. | 8/578 |
| 4,002,423 | 1/1977 | Sahm et al. | 8/1 W |
| 4,093,645 | 6/1978 | Davidson et al. | 260/505 |
| 4,325,863 | 4/1982 | Hinsken et al. | 624/111 |
| 4,338,244 | 7/1982 | Hinsken et al. | 524/109 |
| 4,611,016 | 9/1986 | Hinsken et al. | 529/99 |
| 5,175,312 | 12/1992 | Dubs et al. | 549/307 |

FOREIGN PATENT DOCUMENTS

| | | |
|---|---|---|
| 415887 | 3/1991 | European Pat. Off. . |
| 8001566 | 8/1980 | PCT Int'l Appl. . |

OTHER PUBLICATIONS

Angew. Chem., vol. 87, pp. 693–707 (1975).
Ullman's Encyclopedia of Indus. Chem. 5th Ed., vol. A18, pp. 156–167 (1991).
Chem. Abst. 106(18):147181a (1987).
Chem. Abst. 110(8):59069x (1989).
Chem. Abst. 115(7):71380c (1991).

*Primary Examiner*—Marianne M. Cintins
*Assistant Examiner*—Michael B. Hydorn
*Attorney, Agent, or Firm*—Marla J. Mathias; George R. Dohmann

[57] ABSTRACT

A process is disclosed for treating polyamide fiber containing materials which process comprises applying a benzofuran-2-one compound to the material in order to enhance its moulding stability. In addition, compositions containing a fluorescent whitening agent and a benzofuran-2-one, and optionally one or more dyes, are disclosed.

14 Claims, No Drawings

PROCESS FOR TREATING POLYAMIDE CONTAINING ARTICLES TO ENHANCE THEIR MOULDING STABILITY

The present invention relates to a composition and to a process for the preparation of ultra-white or particularly brilliant coloured polyamide-containing articles which have enhanced moulding stability.

Certain articles made from synthetic fibres are shaped by a heat treatment (moulding). These articles are primarily high-quality articles made from whitened polyamide fibres or also those which consist of polyamide/polyurethane. The hot moulds normally cause a yellowing or even a brown discolouration of the whitened textile material. This discolouration depends greatly on the quality of the polyamide, but especially on the fluorescent whitening agent, and results in fluctuations in the quality of such articles.

It has now been found that it is possible to eliminate the above shortcomings completely, or at least substantially, by using specific benzofuran-2-ones and customary fluorescent whitening agents, also in conjunction with dyes. Surprisingly, compared with merely whitened material, material is obtained which, after moulding, has. superior whiteness, greater brilliance and, in addition, exhibits fewer fluctuations in quality.

The invention therefore relates to the use of, and to a process comprising the use of, benzofuran-2-ones for enhancing the moulding stability of polyamide containing material, as well as to a composition for whitening polyamide containing articles, which composition comprises a fluorescent whitening agent and a benzofuran-2-one, and also to a composition which, in addition to comprising the benzofuran-2-one and the fluorescent whitening agent, further comprises one or more than one dye.

The process for the preparation of polyamide containing articles having enhanced moulding stability comprises applying to the fibres before, during or after whitening and optionally dyeing the fibres, a compound of formula

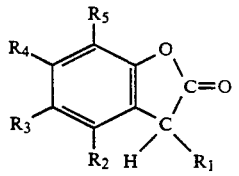

(1)

wherein $R_1$ is unsubstituted or substituted phenyl, wherein the substituents are selected from 1 to 3 alkyl radicals together containing not more than 18 carbon atoms, $C_1$–$C_{12}$alkoxy, $C_1$–$C_{18}$alkoxycarbonyl chloro or a mixture of these substituents, $R_2$ is hydrogen or $C_1$–$C_4$alkyl, $R_4$ is hydrogen, $C_1$–$C_{12}$alkyl, unsubstituted or $C_1$–$C_4$alkyl-substituted $C_5$–$C_7$cycloalkyl, phenyl, $C_7$–$C_{12}$phenylalkyl or chloro, $R_3$ has the meaning of $R_2$ or $R_4$ or is a radical of formula $$-(CH_2)_n\overset{O}{\overset{\|}{C}}-OR_6,\quad -(CH_2)_n\overset{O}{\overset{\|}{C}}-N(R_7)_2,$$

-continued $$-(CH_2)_n\overset{O}{\overset{\|}{C}}-O-A-O-\overset{O}{\overset{\|}{C}}(CH_2)_nE,$$

$$-(CH_2)_n\overset{O}{\overset{\|}{C}}-NR_8-A-NR_8-\overset{O}{\overset{\|}{C}}(CH_2)_nE,$$

$$-(CH_2)_n\overset{O}{\overset{\|}{C}}-NR_8-A-O-\overset{O}{\overset{\|}{C}}(CH_2)_nE,$$

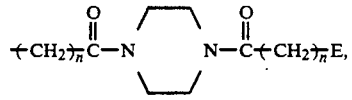

$$-CH_2-S-R_9,\quad -CH(C_6H_5)-\overset{O}{\overset{\|}{C}}-OR_6\quad \text{or}\quad -D-E,$$

wherein n is 0, 1 or 2, $R_6$ is hydrogen, $C_1$–$C_{18}$alkyl, $C_2$–$C_{18}$which is interrupted by oxygen or sulfur, dialkylaminoalkyl containing a total of 3 to 16 carbon atoms, cyclopentyl, cyclohexyl, phenyl or phenyl which is substituted by 1 to 3 alkyl radicals together containing not more than 18 carbon atoms, the substituents $R_7$ are each independently of the other hydrogen, $C_1$–$C_{18}$alkyl, cyclopentyl, cyclohexyl, phenyl, phenyl which is substituted by 1 or 2 alkyl radicals together containing not more than 16 carbon atoms, a radical of formula $-C_2H_4OH$, $-C_2H_4-O-C_{m+1}$ or, $$-C_2H_4-O-\overset{O}{\overset{\|}{C}}-R_{10},$$

or, together with the linking nitrogen atom, form a piperidino or morpholino radical, m is 1 to 18, $R_{10}$ is hydrogen, $C_1$–$C_{22}$alkyl or $C_5$–$C_{12}$cycloalkyl, A is alkylene of 2 to 22 carbon atoms which may be interrupted by nitrogen, oxygen or sulfur, $R_8$ is hydrogen, $C_1$–$C_{18}$alkyl, cyclopentyl, cyclohexyl, phenyl, phenyl which is substituted by 1 or 2 alkyl radicals together containing not more than 16 carbon atoms, or benzyl, $R_9$ is $C_1$–$C_{18}$alkyl, D is —O—, —S—, —SO—, $-SO_2-$ or $-C(R_{11})_2-$, the substituents $R_{11}$ are each independently of the other hydrogen, alkyl together containing not more than 16 carbon atoms, phenyl or a radical of formula $$-(CH_2)_n\overset{O}{\overset{\|}{C}}-OR_6\quad \text{or}\quad -(CH_2)_n\overset{O}{\overset{\|}{C}}-N(R_7)_2.$$

wherein n, $R_6$ and $R_7$ have the given meanings,

E is a radical of formula

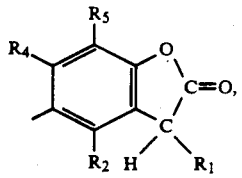

wherein $R_1$, $R_2$ and $R_4$ have the given meanings, and $R_5$ is hydrogen, $C_1$–$C_{30}$alkyl, cyclopentyl, cyclohexyl, chloro or a radical of formula $$-CH_2-\overset{O}{\overset{\|}{C}}-OR_6 \quad \text{or} \quad -CH_2-\overset{O}{\overset{\|}{C}}-N(R_7)_2,$$

wherein $R_6$ and $R_7$ have the given meanings, or $R_5$ together with $R_4$ form a tetramethylene radical.

The benzofuran-2-ones of formula (1) and proceses for their preparation are disclosed in U.S. Pat. Nos. 4,325,863 and 4,338,244.

The alkyl substituents in formula (1) may contain up to 30 carbon atoms. Typical examples are: methyl, ethyl, propyl, butyl, pentyl, hexyl, octyl, nonyl, decyl, undecyl, dodecyl, tetradecyl, hexadecyl, octadecyl, eicosyl or docosyl as well as corresponding branched isomers, preferably tert-butyl, isooctyl and isodecyl. Alkoxy and alkoxycarbonyl radicals are derived from these groups, as are alkylene radicals which are contained in the definitions of the substituents shown in formula (1). The cited alkyl radicals can be interrupted by oxygen or sulfur to form in particular structural units like $-CH_2CH_2-O-CH_2CH_2-$, $-CH_2CH_2-S-CH_2CH_2-$ or $-O-(CH_2)_6-O-$. If the alkyl radicals are substituents at the phenyl rings, then they are preferably in 3- and 5-position.

In preferred benzofuran-2-ones the substituent $R_2$ in the compounds of formula (1) is hydrogen.

$R_3$ is preferably hydrogen, $C_1$–$C_{12}$alkyl, cyclopentyl, cyclohexyl, chloro or a radical of formula $$\left(CH_2\right)_n\overset{O}{\overset{\|}{C}}-OR_6, \quad \left(CH_2\right)_n\overset{O}{\overset{\|}{C}}-N(R_7)_2$$

or —D—E, wherein n, $R_6$, $R_7$, D and E have the given meanings.

The preferred meaning of $R_6$ is hydrogen, $C_1$–$C_{18}$alkyl, cyclopentyl or cyclohexyl.

In a further group of preferred benzofuran-2-ones, $R_1$ is unsubstituted or substituted phenyl, wherein the substituents are 1 or 2 alkyl radicals together containing not more than 12 carbon atoms, $C_1$–$C_{12}$acyloxy or a mixture of these substituents;

$R_2$ is hydrogen and $R_4$ is hydrogen or $C_1$–$C_{12}$alkyl, $R_3$ is hydrogen, $C_1$ –$C_{12}$alkyl, $$\left(CH_2\right)_n\overset{O}{\overset{\|}{C}}-OR_6, \quad \left(CH_2\right)_n\overset{O}{\overset{\|}{C}}-N(R_7)_2$$

or —D—E, $R_5$ is hydrogen, $C_1$–$C_{20}$alkyl, $$-CH_2-\overset{O}{\overset{\|}{C}}-OR_6 \quad \text{or} \quad -CH_2-\overset{O}{\overset{\|}{C}}-N(R_7)_2, \quad \text{or}$$

$R_5$ together with $R_4$ are tetramethylene, and n, $R_6$, $R_7$, D and E have the given meanings.

Preferred compounds of formula (1) from among these compounds are those wherein $R_1$ is phenyl or

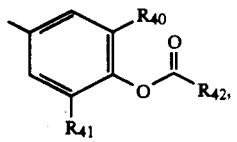

wherein $R_{40}$, $R_{41}$ and $R_{42}$ are each independently of one another hydrogen or $C_1$–$C_8$alkyl, $R_3$ is hydrogen, $C_1$–$C_{12}$alkyl or —D—E, $R_2$ is hydrogen, $R_4$ is hydrogen, or $C_1$–$C_4$alkyl, and $R_5$ is $C_1$–$C_{20}$alkyl, and D and E have the given meanings, and more particularly those compounds wherein $R_1$ is phenyl or

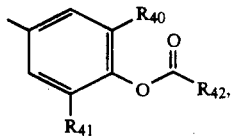

wherein $R_{40}$, $R_{41}$ and $R_{42}$ are each independently of one another hydrogen or $C_1$–$C_4$alkyl, $R_3$ is $C_1$–$C_4$alkyl or —D—E, $R_2$ and $R_4$ is hydrogen, and $R_5$ is $C_1$–$C_4$alkyl or cyclopentyl or cyclohexyl, and D is $-C(R_{11})_2-$ and E is a radical of formula

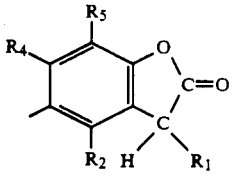

and the substituents $R_{11}$ are identical or different and are each $C_1$–$C_4$alkyl, and $R_1$, $R_2$, $R_4$ and $R_5$ have the given meanings.

Particularly preferred compounds of formula (1) are those wherein $R_1$ is phenyl or

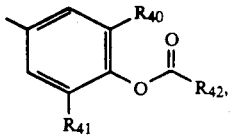

wherein $R_{40}$, $R_{41}$ and $R_{42}$ are each independently of one another $C_1$–$C_4$alkyl, $R_4$ and $R_2$ are hydrogen, $R_3$ and $R_5$ are each independently of the other $C_1$-$C_{18}$alkyl, cyclopentyl or cyclohexyl.

Exemplary of these compounds are compounds (2) and (3):

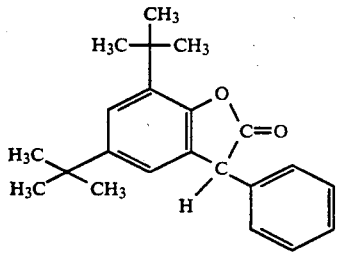

(2)

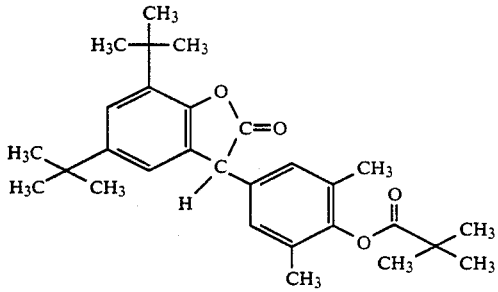

(3)

The compounds of formula (1) are normally applied from an aqueous bath. Application can be made before, during or after whitening the fibres by an exhaust or continuous process. Application jointly with the fluorescent whitening agent is preferred.

In the exhaust process it is possible to use 0.01 to 1%, preferably 0.05 to 0.5%, of fluorescent whitening agent, and 0.01 to 3%, preferably 0.03 to 0.3% of compounds of formula (1).

In the continuous process it is possible to use 0.1 to 10 g/l, preferably 0.2 to 2 g/l, of fluorescent whitening agent, and 0.1 to 30 g/l, preferably 0.2 to 2 g/l, of compounds of formula (1).

Polyamide material will be understood as meaning synthetic polyamide material, typically polyamide 6, polyamide 6,6 or polyamide 12, as well as modified polyamide, e.g. polyamide which is dyeable with basic dyes. In addition to pure polyamide fibres, blends of polyamide and polyurethane, typically tricot material made from a polyamide/polyurethane blend in the ratio 70:30, are also suitable. Basically the pure polyamides or the polyamide blends can be in any form of presentation, for example fibres, yarn, woven and knitted materials, bonded fibre fabrics or pile material.

Fluorescent whitening agents suitable for polyamide containing fibre materials are typically those of the general formulae (5) to (11).

Bis(triazolyl)stilbenes of general formula (5)

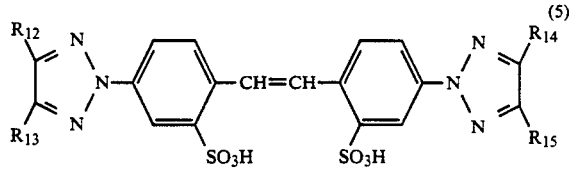

(5)

and e.g. the alkali metal salts thereof, wherein $R_{12}$, $R_{13}$, $R_{14}$ and $R_{15}$ may each independently of one another be H, $C_1$-$C_6$alkyl, phenyl or phenyl which is substituted by e.g. sulfonic acid groups. Bis(triazinylamino)stilbenes of general formula (6)

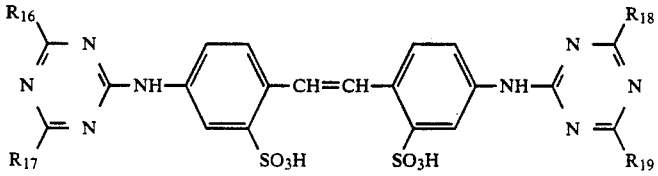

(6)

and e.g. the alkali metal salts thereof, wherein $R_{16}$, $R_{17}$, $R_{18}$ and $R_{19}$ may each independently of one another be

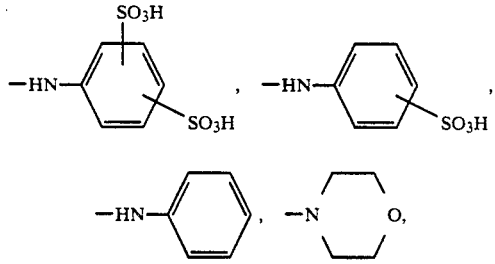

—N($C_1$-$C_6$hydroxyalkyl)$_2$, —N($C_1$-$C_6$alkyl)($C_1$-$C_6$hydroxyalkyl), —$NH_2$, —N($C_1$-$C_6$alkyl)$_2$, $C_1$-$C_6$alkoxy, Cl, —NH—($C_1$-$C_6$sulfoalkyl) or —NH—($C_1$-$C_6$hydroxyalkyl).

Bis(styryl)bisphenyls of general formula (7)

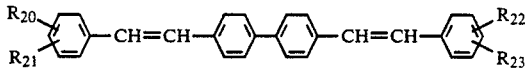

(7)

and e.g. the alkali metal salts thereof, wherein $R_{20}$, $R_{21}$, $R_{22}$ and $R_{23}$ may each independently of one another be H, sulfo or sulfino, —$SO_2$N($C_1$-$C_6$alkyl)$_2$, —$SO_2$—($C_1$-$C_6$alkyl), —$OCH_3$, —CN, —Cl, —$COOCH_3$ or —CON($C_1$-$C_6$alkyl)$_2$.

Bis(benzoxazolyl) derivatives of general formula (8)

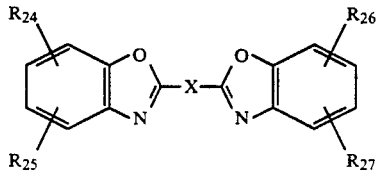

(8)

wherein $R_{24}$, $R_{25}$, $R_{26}$ and $R_{27}$ may each independently of one another be H, branched or unbranched $C_1$-$C_6$alkyl, preferably tert-butyl, tert-butylphenyl or —COOC$_1$-C$_6$alkyl and X may be

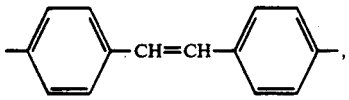

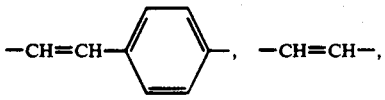

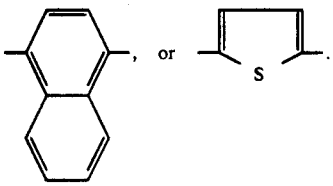

Coumarins of general formula (9)

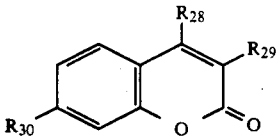

(9)

and e.g. the alkali metal salts thereof, wherein $R_{28}$ may be H, C$_1$-C$_6$alkyl or C$_1$-C$_6$carboxy, $R_{29}$ may be H, phenyl, carboxy-C$_1$-C$_6$alkyl or

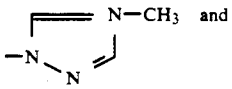

$R_{30}$ may be

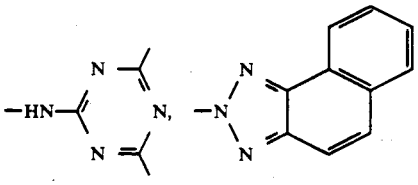

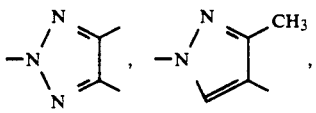

—O—(C$_1$-C$_6$alkyl), —N(C$_1$-C$_6$alkyl)$_2$ or —NH—CO—(C$_1$-C$_6$ alkyl).

Pyrazolines of general formula (10)

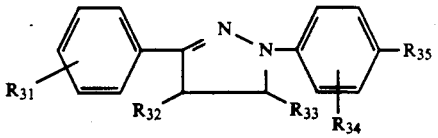

(10)

and e.g. the alkali metal salts thereof, wherein $R_{31}$ is H, Cl or amino (including substituted amines such as methylamines, dimethylamine, diethylamine, diethanolamine, aniline), $R_{32}$ and $R_{33}$ are each independently of the other H or C$_1$-C$_6$alkyl, phenyl, $R_{34}$ is H or Cl and $R_{35}$ is H, Cl sulfo or sulfino, —SO$_2$N(C$_1$-C$_6$alkyl), —OCH$_3$, —CN, —Cl, —COO(C$_1$-C$_6$alkyl) or —CON(C$_1$-C$_6$alkyl)$_2$.

Bis(benzofuranyl)biphenyls of general formula (11)

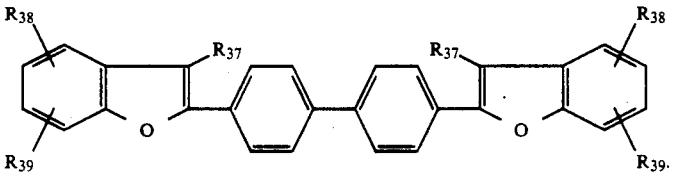

(11)

and e.g. the alkali metal salts thereof, wherein $R_{37}$, $R_{38}$ and $R_{39}$ may each independently of one another be H, halogen, CN, phenoxy, benzyloxy, C$_1$-C$_4$alkyl, C$_1$-C$_4$alkoxy or a sulfonic acid radical.

The aforementioned fluorescent whitening agents are known and their preparation is disclosed, inter alia, in U.S. Pat. No. 4,093,645, Angewandte Chemie, 87, p. 693 and Ullmann's Encyclopedia of Indust. Chem. (5th edition 1991) Vol. A 18, pp. 156–167.

Dyes suitable for the process are all dyes which may suitably be used for dyeing the textiles listed above, typically azo, anthraquinone, nitro, acridone or naphthoquinone dyes.

The invention further relates to a composition for whitening polyamide containing articles having enhanced moulding stability. Such a composition, which can be applied from an aqueous bath, comprises a benzofuran-2-one of formula (1), a fluorescent whitening agent for polyamide (or a mixture thereof), in the case of dyed textiles, one or more dyes, and optional auxiliaries. Preferred compositions comprise a benzofuran-2-one of formula (1), most preferably one of formula (2) or (3), and a fluorescent whitening agent of formulae (5)–(11). The ratio of benzofuran-2-one to fluorescent whitening agent may be in the range from 100:1 to 1:100, a preferred ratio being from 1:20 to 6:1.

The composition for whitening polyamide containing articles having enhanced moulding stability is prepared by mixing the components and also adding the optional auxiliaries.

Conventional auxuliaries may be dispersants, levelling agents and surfactants such as fatty alcohol polyglycol ethers, alkyl ethoxylates, or alkyl phenol ethoxylates, anionic alkyl benzenesulfonates or linear alkyl sulfonates, alone or in conjunction with benzimidazole derivatives or ethoxylated fatty mines, as well as chelating agents such as the sodium salt of ethylenediaminetetraacetic acid, or bleaching agents such as sodium dithionite, as well as combinations of two or more auxiliaries.

The final moulding of the textiles is carried out by conventional methods.

The invention is illustrated by the following non-limitative Examples in which parts and percentages are by weight, based on the weight of the textile material.

In the following Examples PA-6 texturised tricot is used as textile material. The fluorescent whitening agent and the benzofuran-2-one are applied by the exhaust process, in which 3 g/l of stabilised hydrosulfite (Clarit PS®) are added to the treatment bath. The treatment time is 30 minutes at a temperature of 120° C.

The whiteness is determined by the method of Ganz (Ganz, Appl. Optics 18, 1073–1078 (1979)) using a Zeiss RFC 3 spectrometer.

EXAMPLE 1 (COMPARATIVE EXAMPLE)

The fluorescent whitening agent of formula (12)

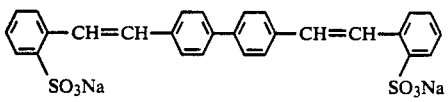

(12)

is applied at a concentration of 0.2% from an aqueous bath. The whiteness rating is 270 units.

One half of the fabric is then subjected to the moulding test:

In a "Rhodiaceta Thermotester" (supplied by Scram, Lyon/F) with 13 heatable metal plates, each measuring 15×35 mm, one of the middle plates is heated to a temperature of 199° C. The lower base is covered with a c. 3 mm thick wool felt underlay. The piece of fabric is moulded for 1 minute (moulding pressure c. 70 g/cm$^2$) and then again examined for its whiteness.

After the moulding test the loss of whiteness is about 50 units.

EXAMPLE 2

The procedure of Example 1 is repeated, with the sole difference that a benzofuran-2-one of formula (2)

(2)

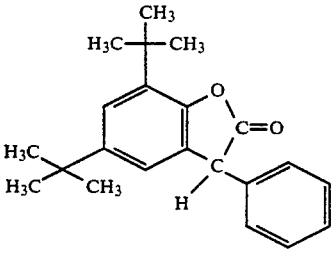

is added in the form of an aqueous dispersion in a concentration of 0.1% to the fluorescent whitening agent in the application bath. After the moulding test according to Example 1, the loss of whiteness is about 20 units and the moulding stability is the same as in Example 1.

EXAMPLE 3 (COMPARATIVE EXAMPLE)

The procedure of Example 1 is repeated, with the sole difference that a fluorescent whitening agent of formula (13)

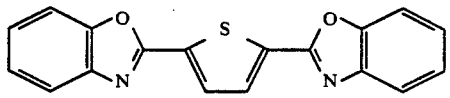

(13)

is used. After the moulding test the loss of whiteness is about 25 units.

EXAMPLE 4

The procedure of Example 3 is repeated, with the sole difference that a benzofuran-2-one of formula

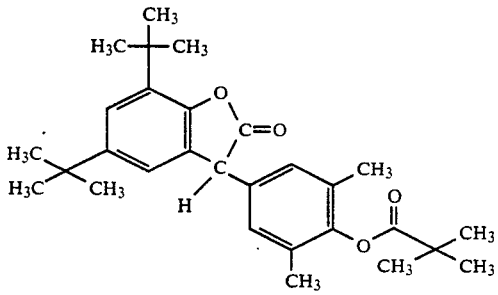

(3)

is added in the form of an aqueous dispersion in a concentration of 0.1% to the fluorescent whitening agent in the application bath. After the moulding test according to Example 1, the loss of whiteness is about 10 units and the moulding stability is the same as in Example 3.

EXAMPLE 5 (COMPARATIVE EXAMPLE)

The procedure of Example 1 is repeated, with the sole difference that a fluorescent whitening agent of formula

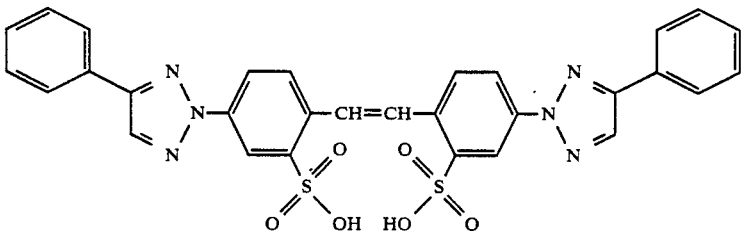

(14)

is used. After the moulding test the loss of whiteness is about 38 units.

EXAMPLE 6

The procedure of Example 5 is repeated, with the sole difference that a benzofuran-2-one of formula (3)

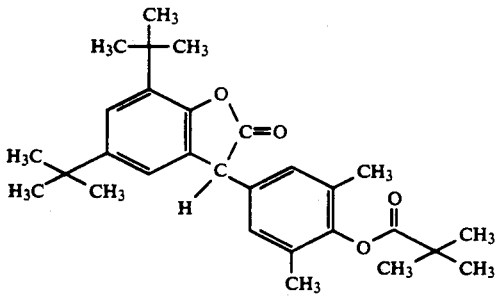

(3)

is added in the form of an aqueous dispersion in a concentration of 0.1% to the fluorescent whitening agent in the application bath. After the moulding test according to Example 1, the loss of whiteness is about 16 units and the moulding stability is the same as in Example 5.

What is claimed is:

1. A process for treating polyamide fibers to enhance their moulding stability, which comprises applying to the fibers before, during or after a whitening step, an aqueous dispersion of a compound or formula

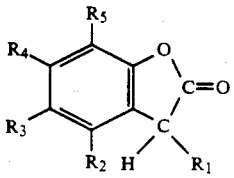

wherein $R_1$ is unsubstituted or substituted phenyl, wherein the substituents are selected from 1 to 3 alkyl radicals containing not more than 18 carbon atoms, $C_1$-$C_{12}$alkoxy, $C_1$-$C_{18}$alkoxycarbonyl, chloro or a mixture of these substituents, $R_2$ is hydrogen or $C_1$-$C_4$alkyl, $R_4$ is hydrogen, $C_1$-$C_{12}$alkyl, unsubstituted or $C_1$-$C_4$alkyl-substituted $C_5$-$C_4$cycloalkyl, phenyl, $C_7$-$C_{12}$phenylalkyl or chloro, $R_3$ is $R_4$, $$-(CH_2)_n\overset{O}{\overset{\|}{C}}-OR_6,\ -(CH_2)_n\overset{O}{\overset{\|}{C}}-N(R_7)_2,$$

$$\left(CH_2\right)_n\overset{O}{\overset{\|}{C}}-O-A-O-\overset{O}{\overset{\|}{C}}\left(CH_2\right)_nE,$$

$$\left(CH_2\right)_n\overset{O}{\overset{\|}{C}}-NR_8-A-NR_8-\overset{O}{\overset{\|}{C}}\left(CH_2\right)_nE,$$

$$\left(CH_2\right)_n\overset{O}{\overset{\|}{C}}-NR_8-A-O-\overset{O}{\overset{\|}{C}}\left(CH_2\right)_nE,$$

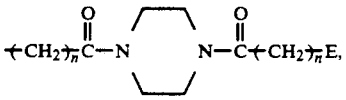

$$-CH_2-S-R_9,\ -CH(C_6H_5)-\overset{O}{\overset{\|}{C}}-OR_6 \text{ or } -D-E,$$

wherein n is 0, 1 or 2, $R_6$ is hydrogen, $C_1$-$C_{18}$alkyl, $C_2$-$C_{18}$alkyl which is interrupted by oxygen or sulfur, dialkylaminoalkyl containing a total of 3 to 16 carbon atoms, cyclopentyl, cyclohexyl, phenyl or phenyl which is substituted by 1 to 3 alkyl radicals together containing not more than 18 carbon atoms, the substituents $R_7$ are each independently of the other hydrogen, $C_1$-$C_{18}$alkyl, cyclopentyl, cyclohexyl, phenyl, phenyl which is substituted by 1 or 2 alkyl radicals together containing not more than 16 carbon atoms, a radical of formula $-C_2H_4OH$, $-C_2H_4-C_2H_4-O-C_mH_{2m+1}$ or $$-C_2H_4-O-\overset{O}{\overset{\|}{C}}-R_{10},$$

or, together with the linking nitrogen atom, form a piperidino or morpholino radical m is 1 to 18, $R_{10}$ is hydrogen, $C_1$-$C_{22}$alkyl or $C_5$-$C_{12}$cycloalkyl, A is alkylene of 2 to 22 carbon atoms which may be interrupted by nitrogen, oxygen or sulfur, $R_8$ is hydrogen, $C_1$-$C_{18}$alkyl, cyclopentyl, cyclohexyl, phenyl, phenyl which is substituted by 1 or 2 alkyl radicals together containing not more than 16 carbon atoms, or benzyl, $R_9$ is $C_1$-$C_{18}$alkyl, D is —O—, S—, —SO—, $-SO_2-$ or $-C(R_{11})_2-$, the substituents $R_{11}$ are each independently of the other hydrogen, alkyl together containing not more than 16 carbon atoms, phenyl or a radical of formula $$\left(CH_2\right)_n\overset{O}{\overset{\|}{C}}-OR_6 \text{ or } \left(CH_2\right)_n\overset{O}{\overset{\|}{C}}-N(R_7)_2,$$

wherein n, $R_6$ and $R_7$ have the given meanings,

E is a radical of formula

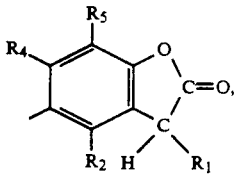

wherein $R_1$, $R_2$ and $R_4$ have the given meanings, and $R_5$ is hydrogen, $C_1$-$C_{30}$alkyl, cyclopentyl, cyclohexyl, chloro or a radical of formula $$-CH_2-\overset{O}{\overset{\|}{C}}-OR_6 \text{ or } -CH_2-\overset{O}{\overset{\|}{C}}-N(R_7)_2,$$

wherein $R_6$ and $R_7$ have the given meanings, or $R_5$ together with R, form a tetramethylene radical.

2. A process according to claim 1 wherein $R_2$ is hydrogen.

3. A process according to claim 1 wherein $R_3$ is hydrogen, $C_1$-$C_{12}$ alkyl, cyclopentyl, cyclohexyl, chloro or a radical of formula

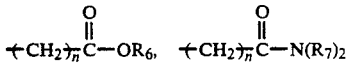

or —D—E.

4. A process according to claim 3 wherein $R_6$ is hydrogen, $C_1$-$C_{18}$alkyl, cyclopentyl or cyclohexyl.

5. A process according to claim 1 wherein $R_1$ is unsubstituted or substituted phenyl, wherein the substituents are 1 or 2 alkyl radicals together containing not more than 12 carbon atoms, $C_1$-$C_{12}$acyloxy or a mixture of these substituents;

$R_2$ is hydrogen, $R_4$ is hydrogen or $C_1$-$C_{12}$alkyl, $R_3$ is hydrogen, $C_1$-$C_{12}$alkyl,

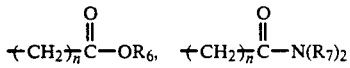

or —D—E, $R_5$ is hydrogen, $C_1$-$C_{20}$alkyl,

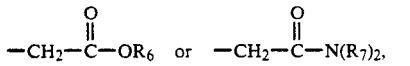

or $R_5$ together with $R_4$ form a tetramethylene radical.

6. A process according to claim 5 wherein $R_1$ is phenyl or

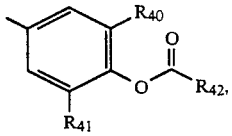

wherein $R_{40}$, $R_{41}$ and $R_{42}$ are each independently of one another hydrogen or $C_1$-$C_8$alkyl, $R_3$ is hydrogen, $C_1$-$C_{12}$alkyl or —D—E, $R_2$ and $R_4$ are each independently of the other hydrogen or $C_1$-$C_4$alkyl, and $R_5$ is $C_1$-$C_{20}$alkyl.

7. A process according to claim 6 wherein $R_1$ is phenyl or

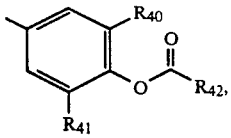

wherein $R_{40}$, $R_{41}$ and $R_{42}$ are each independently of one another hydrogen or $C_1$-$C_4$alkyl, $R_3$ is $C_1$-$C_4$alkyl or —D—E, $R_2$ and $R_4$ are hydrogen, and $R_5$ is $C_1$-$C_4$alkyl or cyclopentyl or cyclohexyl, and D is $—C(R_{11})_2—$ and E is a radical of formula

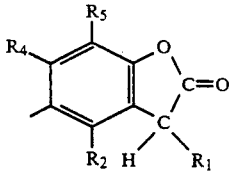

and the substituents $R_{11}$ are identical or different and are each $C_1$-$C_4$alkyl.

8. A process according to claim 1 wherein $R_1$ is phenyl or

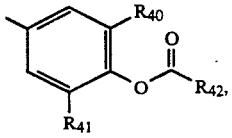

wherein $R_{40}$, $R_{41}$ and $R_{42}$ are each independently of one another $C_1$-$C_4$alkyl, $R_4$ and $R_2$ are hydrogen, $R_3$ and $R_5$ are each independently of the other $C_1$-$C_8$alkyl, cyclopentyl or cyclohexyl.

9. A process according to claim 1 wherein the compound of formula (1) is a compound of formula (2) or (3)

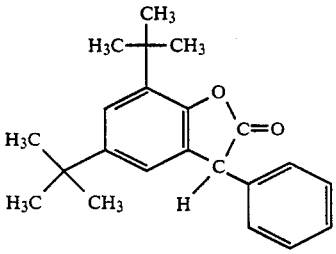

(2)

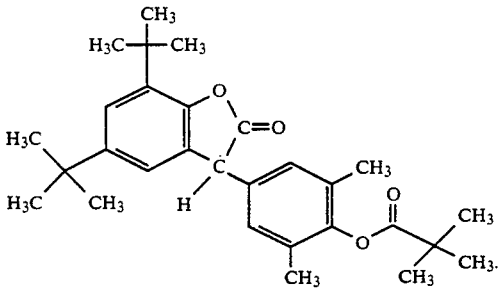

(3)

10. A process according to claim 1 which comprises applying a fluorescent whitening agent having the basic structure of a bis(triazinylamino)stilbene, bis(triazolyl)-stilbene, bis(styryl)biphenyl, bis(benzoxazolyl) derivative, coumarin, pyrazoline or bis(benzofuranyl)biphenyl to the fiber.

11. A process according to claim 10 which comprises applying a mixture of the fluorescent whitening agent and one or more than one dye selected from the group consisting of azo, anthraquinone, nitro, acridone and naphthoquinone dyes.

12. A process according to claim 1 which comprises applying the compound of formula (1) in a concentration of 0.01 to 3% in an exhaust process and in an amount of 0.1 to 30 g/l in a continuous process.

13. A process according to claim 12 which comprise applying the compound of formula (1) in a concentration of 0.03 to 0.3% in the exhaust process and in an amount of 0.2 to 2 g/l in the continuous process.

14. A process of claim 1 wherein the compound of formula (1) and a fluorescent whitening agent are applied to the fibers jointly by an exhaust process.

* * * * *